US005390086A

United States Patent [19]

Holland

[11] Patent Number: 5,390,086

[45] **Date of Patent: * Feb. 14, 1995**

[54] MULTI-CHAMBER CHEMILUMINESCENT OPTICAL DISPLAY DEVICE

[75] Inventor: Stanley Holland, Northridge, Calif.

[73] Assignee: Lexington & Associates, Inc., Northridge, Calif.

[ * ] Notice: The portion of the term of this patent subsequent to Jun. 29, 2010 has been disclaimed.

[21] Appl. No.: 80,573

[22] Filed: Jun. 21, 1993

Related U.S. Application Data

[63] Continuation-in-part of Ser. No. 785,654, Oct. 31, 1991, Pat. No. 5,222,797.

[51] Int. Cl.[6] ..... F21K 2/06

[52] U.S. Cl. ..... 362/34; 362/84; 362/209; 362/216; 362/231; 362/806

[58] Field of Search ..... 362/34, 84, 171, 209, 362/216, 806, 231; 363/3; 252/700

[56] References Cited

U.S. PATENT DOCUMENTS

| | | | |
|---|---|---|---|
| 3,576,987 | 5/1971 | Voight | 362/34 |
| 4,061,910 | 12/1977 | Rosenfeld | 362/34 |
| 4,064,428 | 12/1977 | Van Zandt | 362/34 |
| 4,864,475 | 9/1989 | Jung | 362/231 |
| 5,158,349 | 10/1992 | Holland et al. | 362/34 |
| 5,222,797 | 6/1993 | Holland | 362/84 |

*Primary Examiner*—Ira S. Lazarus
*Assistant Examiner*—L. Heyman
*Attorney, Agent, or Firm*—McHale & Slavin

[57] ABSTRACT

The instant invention teaches the use of conventional chemiluminescent constituents of different colors disposed within at least two chambers [place] placed in a parallel or helically woven pattern. Each chamber sets forth a distinct color that when viewed in combination with an adjoining color emitting chamber, provides a combination color or rainbow type product that cannot be obtained by mixing dyes in a single chamber. The invention further provides [the unique] various color combinations not commonly available due to dye incompatibility.

13 Claims, 2 Drawing Sheets

MULTI-CHAMBER CHEMILUMINESCENT OPTICAL DISPLAY DEVICE

The present application is a continuation-in-part of copending application Ser. No. 07/785,654 filed Oct. 31, 1991 issued Jun. 29, 1993 as U.S. Pat. No. 5,222,797.

FIELD OF THE INVENTION

This invention relates generally to optical display devices, and, more particularly, to a multi-color spectral range display produced by a plurality of chemiluminescent devices interwoven or attached by use of formable housings.

BACKGROUND OF THE INVENTION

The use of an optical chemiluminescent device to produce an artificial light is well known. A chemiluminescent device produces light based on a chemical reaction. U.S. Pat. No. 3,539,794 issued to Rauhut et al., Nov. 10, 1970 discloses a number of chemical compounds and their associated reactions which are typically used in production of chemiluminescent light. Conventionally, the production is based upon the reaction of a catalyzed hydrogen peroxide mixture (activator) with an oxalate such as bis (6-carbopentoxy-2,4,5-trichloropheny) oxalate "CPPO" and a dye in solvent, usually dibutyl phthalate. The activator component contained within a breakable ampule which, when broken, admixes with the oxalate to produce the chemiluminescent light. The activator and oxalate may be reversed.

A fluorescent or dye compound is required for light emission when an oxalic-type chemiluminescent compound is employed. Other compounds may not require a fluorescent but may use it to shift the wavelength of emitted light toward the red region of the spectrum so as to change the color of the emitted light. If the activator and oxalate component are premixed, the reaction between the components can be inhibited or stopped by freezing the mixture.

A unique aspect of chemiluminescent light is that, in addition to the production of light, the chemical reaction generates negligible heat and can be used without danger of causing a fire or burning the consumer. This allows incorporation of the chemical into novelty items worn by humans. For example, a necklace can be formed by placing the chemical into a translucent tube or "light stick" and draping the light stick around an individual's neck, in a similar manner as a conventional necklace is worn. Further, the chemical can be used in situations where conventional electrical, battery, or solar powered light is inappropriate. The application may be as minute as a fishing lure or as diverse as a gaseous state known as an explosive environment.

Heretofore, the prior art presented a chemiluminescent light that generated light within a single spectral range. If an alternative color is desired, the conventional manner of obtaining the color is by variation of the dye. Thus, if a fisherman desired the use of a particular color, the fisherman was limited by the available oxalate dyes presented, however, some color combinations are not available due to dye incapability. Further, conventional practice is to keep the housing separate to prevent washout of the emitted light spectrum.

No one heretofore has addressed the need for a chemiluminescent light device that teaches the benefits of placing a plurality of colored chemiluminescent components in a parallel or interwoven fashion, allowing for the distinct characteristics of color blending from a distance. It is, therefore, to the effective resolution of this situation that the present invention is directed.

SUMMARY OF THE INVENTION

Generally, the instant invention relates to a multicolor spectral range display produced by a plurality of chemiluminescent housings or chambers placed in a close proximity. The invention comprises the use of a multiple strand chemiluminescent light device employing a plurality of elongated cylindrical-shaped formable housings made of flexible polyethylene or the like plastic, each housing, or tube, defines an interior chamber where a chemiluminescent reactive mixture is placed. Each chamber having a distinct dye for effectuating various spectral wavelengths.

Accordingly, it is the primary object of the present invention to provide an aesthetically pleasing, simple, and reliable chemiluminescent light device capable of multiple color creation while transcending articulating surfaces for commercial, safety, and/or ornamental display purposes.

It is yet another object of the instant invention to provide a single housing having a plurality of chambers, either spatial spaced or interwoven, each chamber containing a reactive mixture of a predetermined color to effectuate a spectral color that is visually disparate when viewed from various positions.

Another object of the present invention is to provide an interwoven means of placing individual self-contained chemical lights which can be added or removed from a display.

Other objects and advantages of this invention will become apparent from the following description taken in conjunction with the accompanying drawings wherein set forth, by way of illustration and example, certain embodiments of this invention. The drawings constitute a part of this specification and include exemplary embodiments of the present invention and illustrate various objects and features thereof.

BRIEF DESCRIPTION OF THE DRAWINGS

The invention may be better understood by reference to the drawings in which.

DETAILED DESCRIPTION OF THE INVENTION

Figure 1:
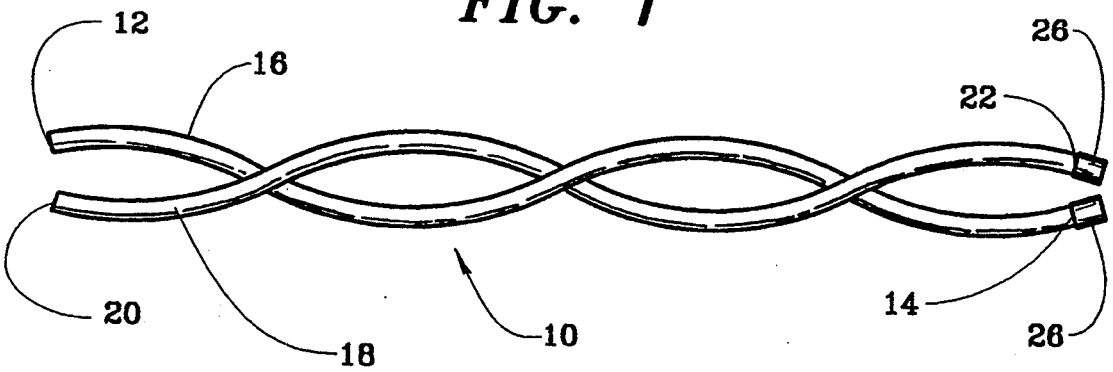
FIG. 1 is a prospective view of a double strand helically woven embodiment of the instant invention.

As required, detailed embodiments of the present invention are disclosed herein, however, it is to be understood that the disclosed embodiments are merely exemplary of the invention which may be embodied in various forms. Therefore, specific functional and structural details disclosed herein are not to be interpreted as limiting, but merely as a basis for the claims and as a representative basis for teaching one skilled in the art to variously employ the present invention in virtually any appropriately detailed structure.

Referring to the drawings in more detail, FIG. 1–4 illustrates a multiple housing chemiluminescent light device 10 of the instant invention comprising a first elongated cylindrical-shaped formable housing 16 having a first end 12 and a second end 14. The preferred housing is made of flexible plastic, such as polyethylene, having properties that permit performed shape remembrance or, alternative, resiliency of original shape progression. The housing 10 can be termed a tube having an inner surface, not shown, defining an interior chamber therebetween. Within the interior chamber of housing 16 is placed a conventional chemiluminescent reactive mixture having a dye or fluorescer Similarly a second elongated cylindrical-shaped formable component creating a first spectral range wavelength. housing 18 has a first end 20 and a second end 22. The housing 18 can be termed a tube having an inner surface, not shown, defining an interior chamber therebetween. Within the interior chamber of housing 18 is placed a conventional chemiluminescent reactive mixture having a dye or fluorescent component creating a second spectral range wavelength.

Housings 16 and 18 can be attached parallel, helically woven about a common axis, or plaited together as illustrated in FIG. 1. Couplings 26 are used to join the first ends 12, 20 and second ends 14, 22 respectfully. Juxtapose placement of housings 16 and 18 create a optical sighting to the human eye in which the spectral range sensation depicts an alternative wavelength when viewed from a distance. For instance, placement of a red fluorescent oxalate in housing 16 and a blue fluorescent oxalate in housing 18 permits the eye to perceive the respective color wavelength as the reactive mixture reacts. However, when a distance is placed between the viewing angle and the combination, the result is the formation of a third colored wavelength that the eye perceives as a single color, in this example pink.

Figure 4:
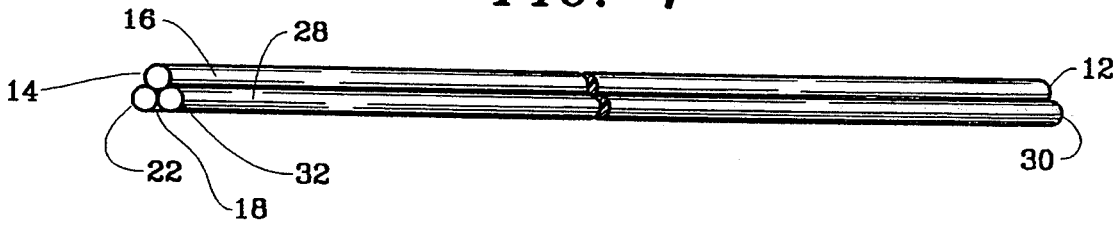
FIG. 4 is a side view of three strands placed in a triangular pattern.

Accordingly, additional strands or housings can be used providing further wavelength variation. For example, if a third strand 28 is employed as in FIGS. 2, 3 and 4, housings 16, 18, and 28 having a separate oxalate dye component, six spectral range wavelengths are possible when the housings are interwoven. A green, red and blue fluorescent base will project such colors that when codified, may be viewed as yellow, pink, aqua, and violet, in addition to the base colors depending upon the viewing distance and angle. Ends 12, 20, and 30 can be coupled to ends 14, 22, and 32 respectfully by coupling means 26, either individually or collectively, forming a circular periphery such as a bracelet, necklace, or the like. Housings 16, 18, 28 can be interwoven as in FIG. 2, parallel as in FIG. 3, or pyramid as shown in FIG. 4.

When used against a single sided surface, a portion of the housings may include reflective characteristics or the like diffusive refraction characteristics incorporated therein such as a prismatic effect integral with said housing outer surface to further enhance the illumination qualities. Alternatively, the housing may be constructed of a colored translucent material.

Storage of admixed components requires freezing to inhibit or stop the chemiluminescent reaction, a procedure well known in the art. To activate, the frozen device is thawed causing reactivation of the chemiluminescent reaction.

Figure 5:
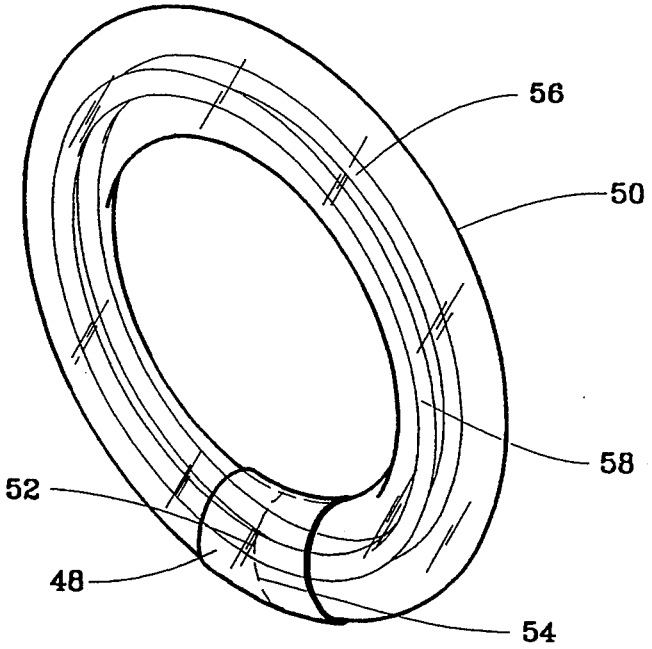
FIG. 5 is a perspective view of an alternate embodiment having a single housing with two chambers shaped in the form of a necklace.

Now referring to FIGS. 5, an alternative embodiment is illustrated wherein elongated cylindrical-shaped housing 50 having a first end 52 and a second end 54. First tubular-shaped chamber 56 and juxtaposed second tubular-shaped chamber 58 extends longitudinally along at least a portion of the housing 50 formed in a parallel plane along a common axis as defined by an centrally disposed straight line axis. A distinct reactive mixture disposed within each of said chambers. Alternatively, chambers 56 and 58 can be helically woven pattern about a common axis.

The device can further be set forth in as a process comprising the steps of: (a) filling a first formable housing having a first end and a second end with a premixed chemiluminescent reactive mixture capable of producing light at temperatures above freezing; (b) sealing the reactive mixture in said first formable housing; (c) filling at least one additional formable housing with a premixed chemiluminescent reactive mixture capable of producing light of a disparate color to said first housing at temperatures above freezing; (d) sealing the reactive mixture in said second formable housing; (e) juxtapositioning said housings in a predetermined position to provide a mixing of chemiluminescent wavelengths thereby providing a distinct visual color ascertainable by the human eye; (f) attaching a means for coupling said first end to said second end on said first end; (h) freezing said formable housings thereby inhibiting chemiluminescent light intensity of said reactive mixture for storage; (i) thawing said formable housings to restore chemiluminescent light intensity of said reactive mixture whereby each reactive mixture produces a chemiluminescent light and the juxtapositioning of said housings mixes chemiluminescent wavelengths to produce said distinct visual color simultaneous and in addition to the chemiluminescent produced colors from each said reactive mixture.

Figure 2:
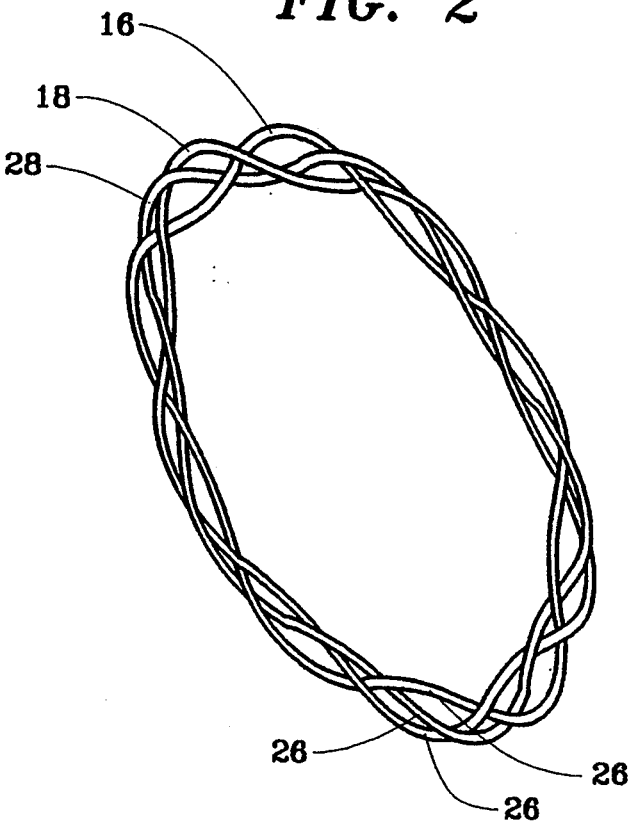
FIG. 2 is a prospective view of a triple strand helically woven embodiment of the instant invention formed into a novelty bracelet.
Figure 3:
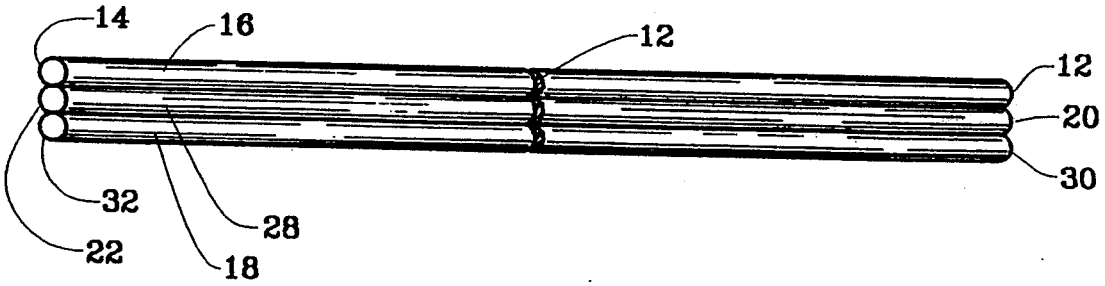
FIG. 3 is a side view of three strands placed in a parallel axis.
Figure 6:
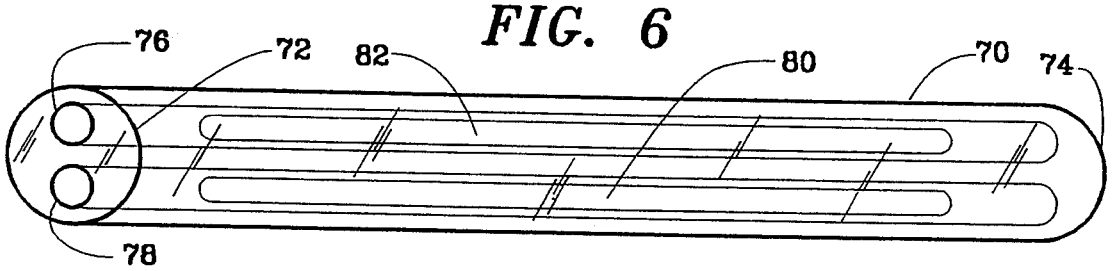
FIG. 6 is a perspective view of an alternative embodiment having a single housing with two chambers incorporating a separate oxalate or activator placed within a breakable ampule within the chamber.

FIG. 6 illustrates a self-activating embodiment of the instant invention wherein a single conventional glass ampule 80 is placed within chamber 78 of housing 70. The housing 70 is defined by an elongated cylindrical-shaped tube having a first end 72 and a second end 74 which encompasses the tubular-shaped chamber 76 and at least one other tubular-shaped chamber 78, both of which extend longitudinally along at least a portion of the housing. The elongated glass ampule 80 and 82 containing either the oxalate or the activator, is inserted into the chamber 76 and 78 during manufacture together with the necessary reactive component to fill the remaining volume of the chamber as defined by the space between the outer surface of the ampule and the inner surface of each said chamber. Upon activation, the housing 70 can be helically woven about a common axis to form a braided structure, as illustrated in FIG. 2, or be formed into a shape before activation by use of alternative ampules described later in this specification. Thus, the housing may consist of a plurality of chambers extending longitudinally along at least a portion of a single housing, or consist of a plurality of individual juxtapositioned hollow elongated formable housings.

Activation of the device is accomplished by flexing the housing thereby causing the ampules to break and release the oxalate or activator to bring about the chemiluminescent reaction. The glass ampule can also be broken by bending, squeezing, or striking the housing against a solid object. Glass ampules can be manufactured without bends, be constructed so that a chamber conforms to the shape of the ampule, or be patterned to conform to the shape of the chamber.

The primary objective of the self activation device is the same as the frozen embodiment, namely, provide a device for the juxtapositioning of chambers in a predetermined position wherein wavelengths produced by each chemiluminescent reaction can be mixed. Therefore, if one of the chambers contains a first oxalate in an ampule and an activator surrounds the ampule, which when mixed together is capable of producing a first visual wavelength, and at least one chamber contains a second oxalate and activator capable of producing a second visual wavelength, the juxtapositioning of the chambers produces a wavelength of distinct visual color ascertainable by the human eye once the chemiluminescent reaction takes place. The distinct visual color is simultaneous and in addition to the chemiluminescent produced color from each chamber. The oxalate and activator placement is reversible.

Figure 7:
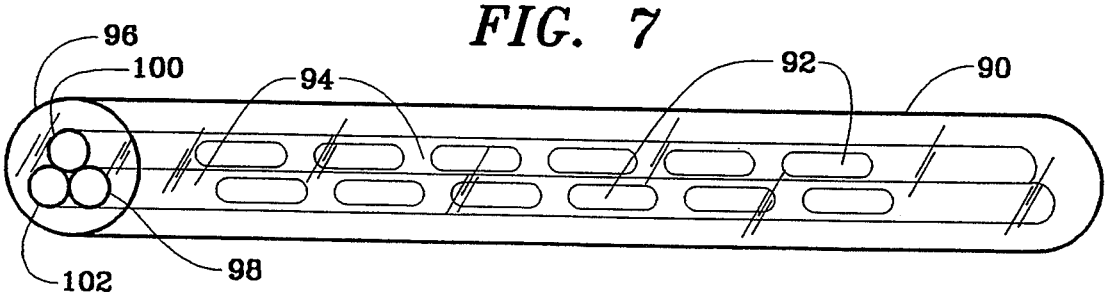
FIG. 7 is a perspective view of an alternative embodiment having a single housing with three chambers incorporating a separate oxalate or activator placed within a breakable ampule within the chamber.

FIG. 7 illustrates another manifestation of the instant invention using self-activating small glass ampules 92 within a single chamber 98. In this embodiment a single chamber can produce multiple colors by mixing wavelengths in a similar manner to the previously described multiple chamber devices. However, unlike the multi-chamber embodiment, the instant embodiment produces multiple colors along the longitudinal length of the chamber. Further, the small ampules need not be limited to a single chamber and, as illustrated in FIG. 7, multiple chambers 98, 100, and 102 can employ small ampules 92 to provide a unique variety of colors in both a longitudinal as well as lateral position. Still further, small ampules 92 permit the housing 90 to be placed into various shapes without breakage of the ampules. For example, a circular necklace could be constructed without activation of the device by use of small spaced apart ampules capable of allowing the required bend.

Accordingly, the multi-chamber device having multiple small ampules is depicted by use of an elongated cylindrical-shaped housing 90 having three tubular-shaped chambers 98, 100, and 102. Each chamber extends longitudinally along at least a portion of the housing 90 wherein the glass ampules 92 are slidably insertable into each chamber. The activator component is placed in the remaining volume 94 of each said chamber as formed by the outer surface of each ampule 92 and the inner surface of the chamber wall. Again it must be noted at this time that the placement of the activator and the oxalate can be reversed.

The use of small ampules of the same kind and juxtapositioned along the longitudinal length of a chamber sets forth the means for mixing wavelengths similar to the aforementioned multi-chamber devices. The use of small ampules of the disparate kind and juxtapositioned along the longitudinal length of a chamber sets forth the means for mixing wavelengths along the longitudinal length of the individual chamber. Thus, when a single chamber 98 contains an activator and a number of individual ampules 92, each containing an oxalate capable of emitting a distinct color upon admixing with an activator, the breakage of an ampule and subsequent mixing of the contents will produce a visual color ascertainable by the human eye. The production of chemiluminescent wavelength is simultaneous and in addition to the chemiluminescent produced wavelengths from each ampule or section of the chamber if the longitudinal length is divided into individual chambers. Thus, a single chamber may produce various colors along its longitudinal length and, by the juxtapositioning of chambers each capable of providing disparate colors, cause a mixing of wavelengths to produce additional colors ascertainable to the human eye both in the longitudinal and lateral viewing position. The longitudinal chamber may be subdivided into individual sections each containing the ampule and activator component or the longitudinal chamber may share a common activator.

It should be noted that plastic ampules can also be used as an alternative to glass ampules and such a substitution is within the scope of this invention. It is well known in the plastic industry that plastic can be formed to assimilate the properties of glass, i.e. holding and rupture strength. For instance, the use of score lines will make the plastic as fragile as a glass ampule wherein the plastic ampule will break under the same conditions as the glass ampule. Thus, substitution of the plastic ampule for the glass ampule will continue to permit activation by flexing of the device. Alternatively, the inner surface of the chamber wall can be formed of sharp edges that will cause the scoring of the plastic ampule for subsequent breakage.

The manufacturing process includes the following steps: (a) sealing a first end of at least one flexible transparent housing containing at least one hollow chamber arranged in a predetermined position and filling said first chamber with an oxalate; (b) inserting an ampule filled with an activator in said first chamber; (c) filling at least one additional flexible housing and/or chamber with an oxalate capable of producing light of a disparate color to said first chamber; (d) inserting an ampule filled with an activator in said second chamber; (e) sealing said oxalate and said ampules in said chambers by sealing open ends to said chambers. The housing is available for activation upon the breakage of said ampules allowing admixing of said oxalate and activator to provide a distinct visual color ascertainable by the human eye. This distinct visual color is simultaneous and in addition to the chemiluminescently produced color emitted from each said chamber. Oxalate and activator placement is reversible.

It is to be understood that while we have illustrated and described certain forms of my invention, it is not to be limited to the specific forms or arrangement of parts herein described and shown. It will be apparent to those skilled in the art that various changes may be made without departing from the scope of the invention and the invention is not to be considered limited to what is shown in the drawings and described in the specification.

I claim:

1. A multi-chamber chemiluminescent light device comprising:

a plurality of individual hollow elongated formable housings, each of said housings having a first end and a second end defining an interior chamber with one of an activator and an oxalate placed therein;

at least one ampule containing the other of said activator and said oxalate disposed within each of said chambers;

said formable housings being juxtaposed in a predetermined position to permit mixing of wavelengths produced by a chemiluminescent reaction upon mixing of said oxalate and said activator;

whereby one of said chambers providing a first visual wavelength and at least one other chamber produces a second visual wavelength, wherein juxtapositioning said housings permits placement of each chamber in a predetermined position providing a wavelength of distinct visual color ascertainable by the human eye, said distinct visual color being simultaneous and in addition to the chemiluminescently produced visual wavelength from each activated oxalate.

2. The multi-chamber chemiluminescent light device according to claim 1, wherein said housings are placed co-planer along a common a axis.

3. The multi-chamber chemiluminescent light device according to claim 1, wherein said housings are constructed of a clear translucent material.

4. The multi-chamber chemiluminescent light device according to claim 1, wherein said housings are constructed of a colored translucent material.

5. The multi-chamber chemiluminescent light device according to claim 1, wherein said housing and said ampule define an outer chamber therebetween fluidly communicating one of said activator and said oxalate throughout said chamber.

6. The multi-chamber chemiluminescent light device according to claim 1, wherein said ampules are constructed of breakable glass.

7. The multi-chamber chemiluminescent light device according to claim 1, wherein said ampules are constructed of plastic.

8. The multi-chamber chemiluminescent light device according to claim 1, wherein said individual housings are positioned within a single housing.

9. A multi-chamber chemiluminescent light device comprising:

an elongated flexible housing having a first end and a second end and a plurality of interior chambers extending longitudinally along at least a portion of said housing, each of said interior chambers containing one of an oxalate and an activator therewithin;

at least one ampule containing the other of said oxalate and said activator placed within each of said interior chambers;

said chambers being juxtaposed in a predetermined position to permit mixing in wavelengths produced by a chemiluminescent reaction upon mixing of said oxalate and said activator;

whereby one of said chambers contains a first oxalate and activator capable of chemiluminescently producing a first visual wavelength and at least one of said chambers contains a second oxalate and activator capable of chemiluminescently producing a second visual wavelength, wherein said chambers are juxtapositioned in a predetermined position providing a wavelength of distinct visual color ascertainable by the human eye, said distinct visual color being simultaneous and in addition to the chemiluminescently produced visual wavelength from each activated oxalate.

10. The multi-chamber chemiluminescent light device according to claim 9, wherein said chambers are placed co-planar along a common axis.

11. The multi-chamber chemiluminescent light device according to claim 9, wherein said ampules are constructed of breakable glass.

12. The multi-chamber chemiluminescent light device according to claim 9, wherein said ampules are constructed of plastic.

13. A process for creating a multi-chamber chemiluminescent light device comprising the steps of:

(a) sealing a first end of a flexible transparent housing containing at least two hollow chambers arranged in a predetermined position and filling a first chamber with one of a first oxalate and activator;

(b) inserting an ampule filled with the other of said first oxalate and activator in said first chamber;

(c) filling a second chamber with one of a second oxalate and activator capable of producing light of a disparate color to that of said first oxalate and activator;

(d) inserting an ampule filled with the other of said second oxalate and activator in said second chamber;

(e) sealing each said ampule in its respective chamber;

(f) said housing available for activation upon the breakage of said ampules allowing admixing of said oxalate and activator to provide a distinct visual color ascertainable by the human eye, said distinct visual color simultaneous and in addition to the chemiluminescently produced color emitted from each said chamber.

* * * * *